US005476760A

United States Patent [19]

Fenton et al.

[11] Patent Number: 5,476,760

[45] Date of Patent: Dec. 19, 1995

[54] PHOTOGRAPHIC EMULSIONS OF ENHANCED SENSITIVITY

[75] Inventors: David E. Fenton; Lucius S. Fox, both of Fairport; Donald L. Black, Webster, all of N.Y.

[73] Assignee: Eastman Kodak Company, Rochester, N.Y.

[21] Appl. No.: 329,591

[22] Filed: Oct. 26, 1994

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,210,450 | 7/1980 | Corben | 430/567 |
| 4,433,048 | 2/1984 | Solberg et al. | 430/434 |
| 4,439,520 | 3/1984 | Kofron et al. | 430/434 |
| 4,883,748 | 11/1989 | Hayakawa | 430/567 |
| 5,061,609 | 10/1991 | Piggin et al. | 430/569 |
| 5,061,616 | 10/1991 | Piggin et al. | 430/569 |
| 5,096,806 | 3/1992 | Nakamura et al. | 430/567 |
| 5,132,203 | 7/1992 | Bell et al. | 430/567 |
| 5,206,133 | 4/1993 | Bando | 430/567 |
| 5,314,798 | 5/1994 | Brust et al. | 430/567 |
| 5,358,840 | 10/1994 | Chaffee et al. | 430/567 |

*Primary Examiner*—Charles L. Bowers, Jr.
*Assistant Examiner*—Mark F. Huff
*Attorney, Agent, or Firm*—Carl O. Thomas

[57] ABSTRACT

Tabular grain emulsions of enhanced photographic sensitivity are disclosed in which the tabular grains contain a maximum surface iodide concentration along their edges and a lower surface iodide concentration within their corners than elsewhere along their edges.

7 Claims, 1 Drawing Sheet

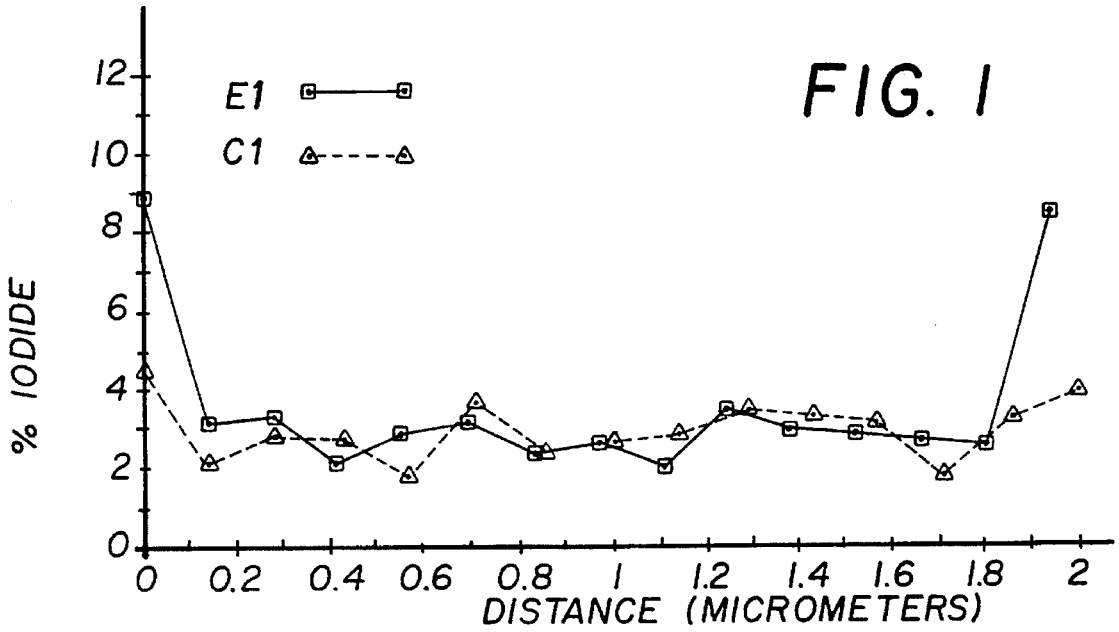
FIG. 1
FIG. 2
(CONTROL)
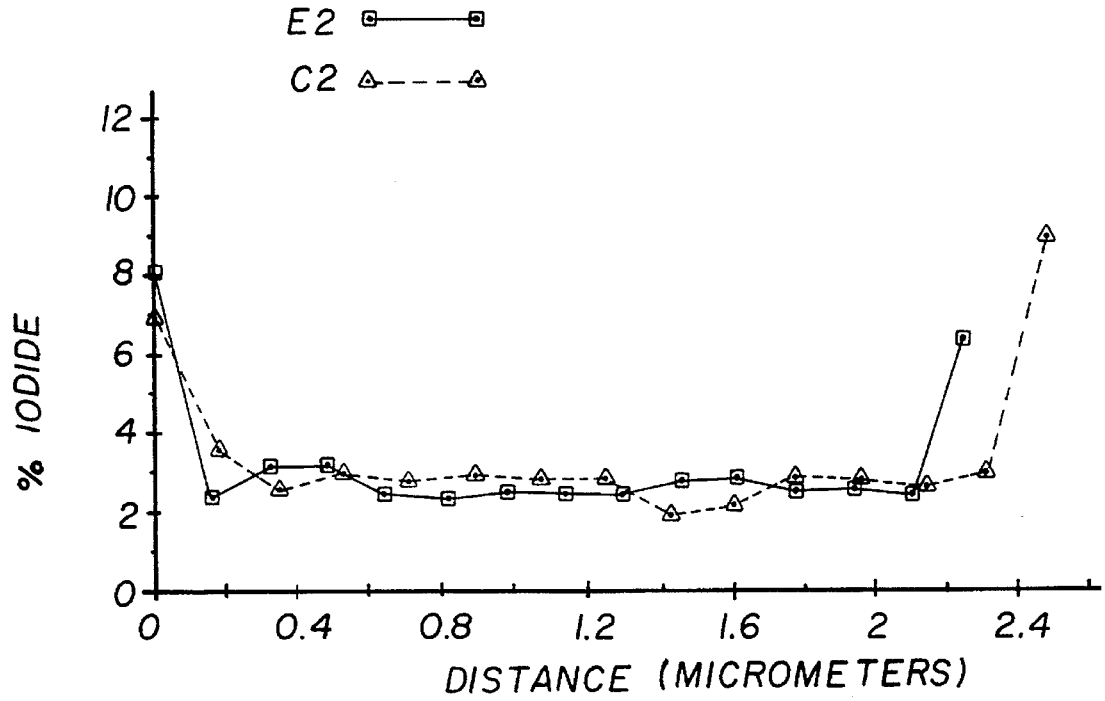

PHOTOGRAPHIC EMULSIONS OF ENHANCED SENSITIVITY

FIELD OF THE INVENTION

The invention relates to photographic emulsions and to processes for their preparation.

BACKGROUND

Kofron et al U.S. Pat. No. 4,439,520 was the first to demonstrate that tabular grain emulsions are capable of providing a variety of photographic advantages, including improvements in photographic sensitivity and speed-granularity relationships.

Solberg et al U.S. Pat. No. 4,433,048 was the first to demonstrate that tabular grain emulsions with higher iodide concentrations adjacent the peripheral edges of the tabular grains are capable of demonstrating photographic sensitivities higher than those of comparable tabular grain emulsions containing the same overall iodide concentrations, but uniformly distributed. Subsequently others have investigated tabular grain emulsions with non-uniform iodide distributions in which the highest iodide level occurs at a surface location, as illustrated by the following: Hayakawa U.S. Pat. No. 4,883,748, Piggin et al U.S. Pat. Nos. 5,061,609 and 5,061,616, Bell et al U.S. Pat. No. 5,132,203, Bando U.S. Pat. No. 5,206,133 and Brust et al U.S. Pat. No. 5,314,798.

Corben U.S. Pat. No. 4,210,450 discloses the preparation of a shelled converted halide emulsion by alternately ammoniacally precipitating silver chloroiodobromide and introducing ammonium iodide and then repeating the sequence. The emulsions are stated to be useful in color diffusion transfer, but no performance advantages are stated or demonstrated.

Chaffee et al U.S. Pat. No. 5,358,840, discloses a tabular grain emulsion in which iodide is present adjacent central portions of the tabular grain major faces extending to a depth of 0.02 μm in a concentration in excess of 6 mole percent with overall iodide concentration of the tabular grains being in the range of from 2 to <10 mole percent.

SUMMARY OF THE INVENTION

In one aspect the invention is directed to an emulsion of enhanced photographic sensitivity comprised of a dispersing medium and silver halide tabular grains having a face centered cubic crystal lattice of the rock salt structure wherein the tabular grains contain a maximum surface iodide concentration along their edges and a lower surface iodide concentration within their corners than elsewhere along their edges.

BRIEF DESCRIPTION OF THE DRAWINGS

FIGS. 1 and 2 each show the iodide concentration profiles of a tabular grain where the profile is taken from edge-to-edge (see line E—E below) or from corner-to-corner (see line C—C below), where FIG. 1 demonstrates profiles from a tabular grain emulsion satisfying the requirements of the invention and FIG. 2 demonstrates iodide profiles from a conventional tabular grain.

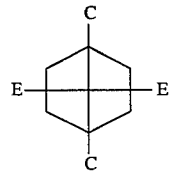

DESCRIPTION OF PREFERRED EMBODIMENTS

It has been discovered quite unexpectedly that enhanced levels of photographic sensitivity without offsetting degradation in granularity can be realized by managing the placement of surface (particularly, edge and corner) iodide in tabular grain emulsions in a manner that has not been heretofore recognized nor attempted. Specifically, the tabular grains contain a maximum surface iodide concentration along their edges and a lower surface iodide concentration within their corners than elsewhere along their edges. The term "surface iodide concentration" refers to the iodide concentration that lies within 0.02 μm of the tabular grain surface.

The starting point for the preparation of an emulsion satisfying the requirements of the invention can be any conventional tabular grain emulsion in which the tabular grains (1) exhibit a face centered cubic crystal lattice of the rock salt structure and (2) have a surface iodide concentration of less than 2 mole percent.

Both silver bromide and silver chloride exhibit a face centered cubic crystal lattice structure. Thus, the starting tabular grains can be selected from among silver bromide, silver chloride, silver chlorobromide and silver bromochloride. Although silver iodide does not form a face centered cubic crystal lattice structure (except under conditions not relevant to photography), minor amounts iodide can be tolerated in the face centered cubic crystal lattice structures formed by silver chloride and/or bromide. Thus, the starting tabular grains grains can additionally include silver iodobromide, silver iodochloride, silver iodochlorobromide, silver iodobromochloride, silver chloroiodobromide and silver bromoiodochloride compositions, provided surface iodide concentrations are limited to satisfy criterion (2) above.

In referring to silver halide grains or emulsions containing two or more halides the halides are named in the order of ascending concentrations.

Conventional tabular grain emulsions suitable for use as starting emulsions, that is, satisfying criteria (1) and (2), can be selected from among those having either {111} or {100} major faces. Suitable tabular grain emulsions containing {111} major face tabular grains are illustrated by Wey U.S. Pat. No. 4,399,215, Maskasky U.S. Pat. Nos. 4,400,463, 4,684,607, 4,713,320, 4,713,323, 5,061,617, 5,178,997, 5,178,998, 5,183,732, 5,185,239, 5,217,858 and 5,221,602, Wey et al U.S. Pat. No. 4,414,306, Daubendiek et al U.S. Pat. Nos. 4,414,310, 4,672,027, 4,693,964 and 4,914,014, Abbott et al U.S. Pat. No. 4,425,426, Wilgus et al U.S. Pat. No. 4,434,226, Kofron et al U.S. Pat. No. 4,439,520, Sugimoto et al U.S. Pat. No. 4,665,012, Yagi et al U.S. Pat. No. 4,686,176, Hayashi U.S. Pat. No. 4,748,106, Goda U.S. Pat. No. 4,775,617, Takada et al U.S. Pat. No. 4,783,398, Saitou et al U.S. Pat. Nos. 4,797,354 and 4,977,074, Tufano U.S.

Pat. No. 4,801,523, Tufano et al U.S. Pat. No. 4,804,621, Ikeda et al U.S. Pat. No. 4,806,461 and EPO 0 485 946, Makino et al U.S. Pat. No. 4,853,322, Nishikawa et al U.S. Pat. No. 4,952,491, Houle et al U.S. Pat. No. 5,035,992, Takehara et al U.S. Pat. No. 5,068,173, Nakamura et al U.S. Pat. No. 5,096,806, Tsaur et al U.S. Pat. Nos. 5,147,771, '772, '773, 5,171,659, 5,210,013 and 5,252,453, Jones et al U.S. Pat. No. 5,176,991, Maskasky et al U.S. Pat. No. 5,176,992, Black et al U.S. Pat. No. 5,219,720, Maruyama et al U.S. Pat. No. 5,238,796, Antoniades et al U.S. Pat. No. 5,250,403, Zola et al EPO 0 362 699, Urabe EPO 0 460 656, Verbeek EPO 0 481 133, EPO 0 503 700 and EPO 0 532 801, Jagannathan et al EPO 0 515 894 and Sekiya et al EPO 0 547 912. Emulsions containing {100} major face tabular grains useful as starting emulsions are illustrated by Bogg U.S. Pat. No. 4,063,951, Mignot U.S. Pat. No. 4,386,156, Maskasky U.S. Pat. Nos. 5,264,337 and 5,275,930, Brust et al U.S. Pat. No. 5,314,798, House et al U.S. Pat. Nos. 5,320,938, Saitou et al EPO 0 569 971 and Saito et al Japanese Patent Application 92/77261.

In their simplest form the starting tabular grains contain less than 2 mole percent iodide throughout. However, the presence of higher levels of iodide within the interior of the tabular grains is compatible with the practice of the invention, provided a lower iodide shell is present that brings the starting tabular grains into conformity with criterion (2).

The surface iodide modification of the starting tabular grain emulsion to enhance sensitivity can commence under any convenient conventional emulsion precipitation condition. For example, iodide introduction can commence immediately upon completing precipitation of the starting tabular grain emulsion. When the starting tabular grain emulsion has been previously prepared and is later introduced into the reaction vessel, conditions within the reaction vessel are adjusted within conventional tabular grain emulsion preparation parameters to those present at the conclusion of starting tabular grain emulsion precipitation, taught by the starting tabular grain emulsion citations above. For starting tabular grain emulsions in which the tabular grains have {111} major faces the teachings of Kofron et al, cited above and here incorporated by reference, are generally applicable and preferred.

Iodide is introduced as a solute into the reaction vessel containing the starting tabular grain emulsion. Any water soluble iodide salt can be employed for supplying the iodide solute. For example, the iodide can be introduced in the form of an aqueous solution of an ammonium, alkali or alkaline earth iodide.

Instead of providing the iodide solute in the form of an iodide salt, it can instead be provided in the form of an organic iodide compound, as taught by Kikuchi et al EPO 0 561 415. In this instance a compound satisfying the formula:

$$R—I \quad (I)$$

is employed, wherein R represents a monovalent organic residue which releases iodide ion upon reacting with a base or a nucleophilic reagent acting as an iodide releasing agent. When this approach is employed iodide compound (I) is introduced followed by introduction of the iodide releasing agent.

As a further improvement R—I can be selected from among the methionine alkylating agents taught by King et al U.S. Pat. No. 4,942,120, the disclosure of which is here incorporated by reference. These compounds include α-iodocarboxylic acids (e.g., iodoacetic acid), α-iodoamides (e.g., iodoacetamide), iodoalkanes (e.g., iodomethane) and iodoalkenes (e.g., allyl iodide).

A common alternative method in the art for introducing iodide during silver halide precipitation is to introduce iodide ion in the form of a silver iodide Lippmann emulsion. The introduction of iodide in the form of a silver salt does not satisfy the requirements of the invention.

In the preparation of the tabular grain emulsions of the invention iodide ion is introduced without concurrently introducing silver. This creates conditions within the emulsion that drive iodide ions into the face centered cubic crystal lattice of the tabular grains. The driving force for iodide introduction into the tabular grain crystal lattice structure can be appreciated by considering the following equilibrium relationship:

$$Ag^+ + X^- \leftrightharpoons AgX \quad (II)$$

where X represents halide. From relationship (II) it is apparent that most of the silver and halide ions at equilibrium are in an insoluble form while the concentration of soluble silver ions ($Ag^+$) and halide ions ($X^-$) is limited. However, it is important to observe the equilibrium is a dynamic equilibrium—that is, a specific iodide is not fixed in either the right hand or left hand position in relationship (II). Rather, a constant interchange of iodide ion between the left and right hand positions is occurring.

At any given temperature the activity product of $Ag^+$ and $X^-$ is at equilibrium a constant and satisfies the relationship:

$$Ksp=[Ag^+][X^-] \quad (III)$$

where Ksp is the solubility product constant of the silver halide. To avoid working with small fractions the following relationship is also widely employed:

$$-\log Ksp = pAg + pX \quad (IV)$$

where pAg represents the negative logarithm of the equilibrium silver ion activity and pX represents the negative logarithm of the equilibrium halide ion activity.

From relationship (IV) it is apparent that the larger the value of the –log Ksp for a given halide, the lower is its solubility. The relative solubilities of the photographic halides (Cl, Br and I) can be appreciated by reference to Table I:

TABLE I

| Temp. °C. | AgCl –log Ksp | AgI –log Ksp | AgBr –log Ksp |
|---|---|---|---|
| 40 | 9.2 | 15.2 | 11.6 |
| 50 | 8.9 | 14.6 | 11.2 |
| 60 | 8.6 | 14.1 | 10.8 |
| 80 | 8.1 | 13.2 | 10.1 |

From Table I it is apparent that at 40° C. the solubility of AgCl is one million times higher than that of silver iodide, while, within the temperature range reported in Table I the solubility of AgBr ranges from about one thousand to ten thousand times that of AgI. Thus, when iodide ion is introduced into the starting tabular grain emulsion without concurrent introduction of silver ion, there are strong equilibrium forces at work driving the iodide ion into the crystal lattice structure in displacement of the more soluble halide ions already present.

The benefits of the invention are not realized if all of the more soluble halide ions in the crystal lattice structure of the starting tabular grains are replaced by iodide. This would destroy the face centered cubic crystal lattice structure, since iodide can only be accommodated in a lattice structure to a limited degree, and the net effect would be to destroy the tabular configuration of the grains. Thus, it is specifically contemplated to limit the iodide ion introduced to 10 mole percent or less, preferably 5 mole percent or less, of the total silver forming the starting tabular grain emulsion. A minimum iodide introduction of at least 0.5 mole percent, preferably at least 1.0 mole percent, based on starting silver, is contemplated.

When the iodide ion is run into the starting tabular grain emulsion at rates comparable to those employed in conventional double-jet run salt additions, the iodide ion that enters the tabular grains by halide displacement is not uniformly or randomly distributed. Clearly the surface of the tabular grains are more accessible for halide displacement. Further, on the surfaces of the tabular grains, halide displacement by iodide occurs in a preferential order. Assuming a uniform surface halide composition in the starting tabular grains, the crystal lattice structure at the corners of the tabular grains is most susceptible to halide ion displacement, followed by the edges of the tabular grains. The major faces of the tabular grains are least susceptible to halide ion displacement. It is believed that, at the conclusion of the iodide ion introduction step (including any necessary introduction of iodide releasing agent), the highest iodide concentrations in the tabular grains occur in that portion of the crystal lattice structure forming the corners of the tabular grains.

The next step of the process of preparation is to remove iodide ion selectively from the corners of the tabular grains. This is accomplished by introducing silver as a solute. That is, the silver is introduced in a soluble form, analogous to that described above for iodide introduction. In a preferred form the silver solute is introduced in the form of an aqueous solution similarly as in conventional single-jet or double-jet precipitations. For example, the silver is preferably introduced as an aqueous silver nitrate solution. No additional iodide ion is introduced during silver introduction.

The amount of silver introduced is in excess of the iodide introduced into the starting tabular grain emulsion during the iodide introduction step. The amount of silver introduced is preferably on a molar basis from 2 to 20 (most preferably 2 to 10) times the iodide introduced in the iodide introduction step.

When silver ion is introduced into the high corner iodide tabular grain emulsion, halide ion is present in the dispersing medium available to react with the silver ion. One source of the halide ion comes from relationship (II). The primary source of halide ion, however, is attributable to the fact that photographic emulsions are prepared and maintained in the presence of a stoichiometric excess of halide ion to avoid the inadvertent reduction of $Ag^+$ to $Ag^o$, thereby avoiding elevating minimum optical densities observed following photographic processing.

As the introduced silver ion is precipitated, it removes iodide ion from the dispersing medium. To restore the equilibrium relationship with iodide ion in solution the silver iodide at the corners of the grains (see relationship II above) exports iodide ion from the corners of the grains into solution, where it then reacts with additionally added silver ion. Silver and iodide ion as well as chloride and/or bromide ion, which was present to provide a halide ion stoichiometric excess, are then redeposited.

To direct deposition to the edges of the tabular grains and thereby avoid thickening the tabular grains as well as to avoid silver ion reduction, the stoichiometric excess of halide ion is maintained and the concentration of the halide ion in the dispersing medium is maintained in those ranges known to be favorable for tabular grain growth. For example, for high (>50 mole percent) bromide emulsions the pBr of the dispersing medium is maintain at a level of at least 1.0. For high (>50 mole percent) chloride emulsions the molar concentration of chloride ion in the dispersing medium is maintained above 0.5M. Depending upon the amount of silver introduced and the initial halide ion excess in the dispersing medium, it may be necessary to add additional bromide and/or chloride ion while silver ion is being introduced. However, the much lower solubility of silver iodide as compared to silver bromide and/or chloride, results in the silver and iodide ion interactions described above being unaffected by any introductions of bromide and/or chloride ion.

The net result of silver ion introduction as described above is that silver ion is deposited at the edges of the tabular grains. Concurrently, iodide ion migrates from the corners of the tabular grains to their edges. As iodide ion is displaced from the tabular grain corners, irregularities are created in the corners of the tabular grains that increase their latent image forming efficiency. It is preferred that the tabular grains exhibit a corner surface iodide concentration that is at least 0.5 mole percent, preferably at least 1.0 mole percent, lower than the highest surface iodide concentration found in the grain—i.e., at the edge of the grain.

Apart from the features described above the tabular grain emulsions of the invention can take any convenient conventional form. If the starting tabular grain emulsion contains no iodide, a minimum amount of iodide is introduced during the iodide introduction step, and a maximum amount of silver is introduced during the subsequent silver ion introduction step, the minimum level of iodide in the resulting emulsion can be as low as 0.4 mole percent. With higher levels of iodide introduction, lower levels of subsequent silver ion introduction, and/or iodide initially present in the starting tabular grains, much higher levels of iodide can be present in the tabular grain emulsions of the invention. Preferred emulsions according to the invention contain overall iodide levels of up to 20 mole percent, most preferably, up to 15 mole percent. A preferred minimum overall iodide concentration is 1.0 mole percent, with higher overall iodide concentrations being preferred for photographic applications depending upon iodide release for photographic advantages, such as reliance upon iodide to increase native blue sensitivity or reliance upon iodide ions released in development for interimage effects. For rapid access processing, such as is typically practiced in medical radiography, overall concentrations are preferably maintained at less than 5 mole percent, optimally at less than 3 mole percent.

In the preferred emulsions according to the invention the tabular grains account for greater than 50 percent of total grain projected area. The tabular grains most preferably account for at least 70 percent, optimally at least 90 percent, of total grain projected area. Any proportion of tabular grains satisfying the iodide profile requirements noted above can be present that is capable of observably enhancing photographic sensitivity. When all of the tabular grains are derived from the same emulsion precipitation, at least 25 percent of the tabular grains exhibit the iodide profiles described above. Preferably tabular grains accounting for at least 50 percent of total grain projected area exhibit the iodide profiles required by the invention.

Preferred emulsions according to the invention are those which are relatively monodisperse. In quantitative terms it is preferred that the coefficient of variation (COV) of the equivalent circular diameters (ECD's), based on the total grain population of the emulsion as precipitated be less than about 30 percent, preferably less than 20 percent. The COV of ECD is also referred to as $COV_{ECD}$. By employing a highly monodisperse starting tabular grain emulsion, such as an emulsion having a $COV_{ECD}$ of less than 10 percent (disclosed, for example, by Tsaur et al U.S. Pat. No. 5,210,013, the disclosure of which is here incorporated by reference), it is possible to prepare emulsions according to the invention in which $COV_{ECD}$ of the final emulsion is also less than 10. The silver bromide and iodobromide tabular grain emulsions of Tsaur et al U.S. Pat. Nos. 5,147,771, '772, '773, and 5,171,659 represent a preferred class of starting tabular grain emulsions. Sutton et al U.S. Pat. No. 5,334,469 discloses improvements on these emulsions in which the COV of tabular grain thickness, $COV_t$, is less than 15 percent.

The average tabular grain thicknesses (t), ECD's, aspect ratios (ECD/t) and tabularities ($ECD/t^2$, where ECD and t are measured in micrometers, μm) of the emulsions of the invention can be selected within any convenient conventional range. The tabular grains preferably exhibit an average thickness of less than 0.3 μm. Ultrathin (<0.07 μm mean thickness) tabular grain emulsions are specifically contemplated. Photographically useful emulsions can have average ECD's of up to 10 μm, but in practice they rarely have average ECD's of greater than 6 μm. For relatively slow speed photographic applications any minimum mean ECD of the emulsions of the invention that is compatible with average aspect ratio requirements can be employed. It is preferred to require individual grains to have parallel major faces and to exhibit an average aspect ratio of at least 2 to be considered tabular. Thus the average aspect ratio of the emulsions is always greater than 2, preferably greater than 5 and most preferably greater than 8. Extremely high average aspect ratios of 100 or more are contemplated, although typically tabular grain emulsion average aspect ratios are less than 75.

During their preparation, either during preparation of the starting tabular grain emulsions or during iodide and/or silver addition, the tabular grain emulsions of the invention can be modified by the inclusion of one or more dopants, illustrated by *Research Disclosure*, Vol. 365, September 1994, Item 36544, I. Emulsion grains and their preparation, D. Grain modifying conditions and adjustments, paragraphs (3), (4) and (5). *Research Disclosure* is published by Kenneth Mason Publications, Ltd., Dudley House, 12 North St., Emsworth, Hampshire P010 7DQ, England. Among conventional emulsion preparation techniques specifically contemplated to be compatible with the present invention are those disclosed in *Research Disclosure*, Item 36544, I. Emulsion grains and their preparation, A. Grain halide composition, paragraph (5); C. Precipitation procedures; and D. Grain modifying conditions and adjustments, paragraphs (1) and (6).

Subsequent to their precipitation the emulsions of the invention can be prepared for photographic use as described by *Research Disclosure,* 36544, cited above, I. Emulsion grains and their preparation, E. Blends, layers and performance categories; II. Vehicles, vehicle extenders, vehicle-like addenda and vehicle related addenda; III. Emulsion washing; IV. Chemical sensitization; and V. Spectral sensitization and desensitization, A. Spectral sensitizing dyes.

The emulsions or the photographic elements in which they are incorporated can additionally include one or more of the following features illustrated by Research Disclosure, Item 36544, cited above: VII. Antifoggants and stabilizers; VIII. Absorbing and scattering materials; IX. Coating physical property modifying addenda; X. Dye image formers and modifiers; XI. Layers and layer arrangements; XII. Features applicable only to color negative; XIII. Features applicable only to color positive; XIV. Scan facilitating features; and XV. Supports.

The exposure and processing of photographic elements incorporating the emulsions of the invention can take any convenient conventional form, illustrated by *Research Disclosure*, Item 36544, cited above, XVI. Exposure; XVIII. Chemical development systems; XIX. Development; and XX. Desilvering, washing, rinsing and stabilizing.

Examples

The invention can be better appreciated by reference to the following specific embodiments.

Emulsion 1C (a comparative emulsion)

In a 4-liter reaction vessel was placed an aqueous gelatin solution (composed of 1 liter of water, 0.56 g of alkali-processed low methionine gelatin, 3.5 ml of 4N nitric acid solution, 1.12 g of sodium bromide and having a pAg of 9.38 and 14.4 wt %, based on total silver used in nucleation, of PLURONIC-31R1™ (a surfactant satisfying the formula:

$$HO-(\overset{\overset{CH_3}{|}}{C}HCH_2O)_y-(CH_2CH_2O)_x-(\overset{\overset{CH_3}{|}}{C}HCH_2O)_{y'}-H$$

where x=7, y=25 and y'=25) while keeping the temperature thereof at 45° C., 11.13 mL of an aqueous solution of silver nitrate (containing 0.48 g of silver nitrate) and 11.13 mL of an aqueous solution of sodium bromide (containing 0.29 g of sodium bromide) were simultaneously added thereto over a period of 1 minute at a constant rate. The mixture was held and stirred for 1 minute during which 14 mL of an aqueous sodium bromide solution (containing 1.44 g of sodium bromide) were added at the 50 second point of the hold. Thereafter, after the 1 minute hold, the temperature of the mixture was raised to 60° C. over a period of 9 minutes. Then 16.7 mL of an aqueous solution of ammonium sulfate (containing 1.68 g of ammonium sulfate) were added and the pH of the mixture was adjusted to 9.5 with aqueous sodium hydroxide (1N). The mixture thus prepared was stirred for 9 minutes. Then 83 mL of an aqueous gelatin solution (containing 16.7 g of alkali-processed gelatin) was added, and the mixture was stirred for 1 minute, followed by a pH adjustment to 5.85 using aqueous nitric acid (1N). The mixture was stirred for 1 minute. Afterward, 30 mL of aqueous silver nitrate (containing 1.27 g of silver nitrate) and 32 mL of aqueous sodium bromide (containing 0.66 g of sodium bromide) were added simultaneously over a 15 minute period. Then 49 mL of aqueous silver nitrate (containing 13.3 g of silver nitrate) and 48.2 mL of aqueous sodium bromide (containing 8.68 g of sodium bromide) were added simultaneously at linearly accelerated rates starting from respective rates of 0.67 mL/min and 0.72 mL/min for the subsequent 24.5 minutes. Then 468 mL of aqueous silver nitrate (containing 191 g of silver nitrate) and 464 mL of aqueous sodium bromide (copraining 119.4 g of sodium bromide) were added simultaneously at linear accelerated rates starting from respective rates of 1.67 mL/min and 1.70 mL/min for the subsequent 82.4 minutes. A 1 minute hold while stirring followed.

Then 80 mL of an aqueous silver nitrate solution (containing 32.6 g of silver nitrate) and 69.6 mL of an aqueous halide solution (containing 13.2 g of sodium bromide and 10.4 g of potassium iodide) were added simultaneously over a 9.6 minute period at constant rates. Then 141 mL of an aqueous silver nitrate solution (containing 57.5 g of silver nitrate) and 147.6 mL of aqueous sodium bromide (containing 38.0 g of sodium bromide) were added simultaneously over a 16.9 minute period at constant rates. The silver iodobromide emulsion thus obtained contained 3.6 mole percent iodide. The emulsion was then washed. The properties of grains of this emulsion are shown in Table II.

Emulsion 2E (an Example emulsion)

The procedure used to prepare Emulsion 1 was employed up to the step at which iodide was introduced. From that point the precipitation proceeded as follows:

Then 16.6 mL of an aqueous potassium iodide solution (containing 10.45 g of potassium iodide) were added over a three minute period at constant flow rate. The solution was delivered to a position in the kettle such that mixing was maximized. After a 10 minute hold, 220.8 mL of an aqueous silver nitrate solution (containing 90.1 g of silver nitrate) were added over a 26.5 minute period at constant flow rate. Then 6.5 minutes after the start of the silver nitrate addition 164.2 mL of aqueous sodium bromide (containing 42.2 g of sodium bromide) were added over a 20.0 minute period at a constant rate. The silver halide emulsion thus obtained contained 3.6 mole percent iodide. The emulsion was then washed. The properties of grains of this emulsion are shown in Table II.

TABLE II

| | Comparison of the Grain Properties | | | | |
|---|---|---|---|---|---|
| | Average Grain Size (μm) | Thickness (μm) | Aspect Ratio | Average Tabularity | $COV_{ECD}$ (%) |
| Emulsion 1 | 2.37 | 0.11 | 22 | 196 | 9.8 |
| Emulsion 2 | 2.31 | 0.12 | 19 | 160 | 9.3 |

Photographic Comparison

The emulsions listed in Table II were optimally sulfur and gold sensitized and minus blue sensitized with a combination of anhydro-5-chloro-9 -ethyl-5'-phenyl-3'-(3-sulfobutyl)-3-(3-sulfopropyl)oxacarbocyanine hydroxide, sodium salt (SS-1) and anhydro-3,9-diethyl-3'-[N-(methylsulfonyl-)carbamoylmethyl]-5-phenylbenzothiazolooxacarbocyanine hydroxide, inner salt (SS-2) in an 8.2:1 ratio by weight, as the sensitizing dyes present in the finish. Single layer coatings on a transparent film support employed cyan dye-forming coupler (CC-1) at a coating coverage of 1.6 mg/dm$^2$ and a silver coating coverage of 8.1 mg/dm$^2$.

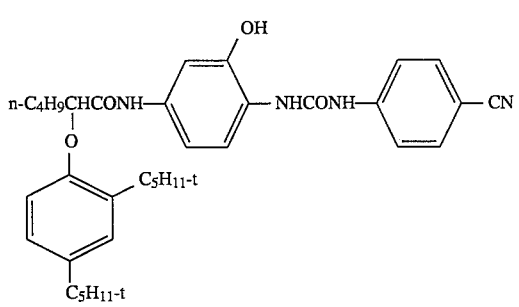

(CC-1)

A sample of each coating was exposed by a tungsten light source through a graduated density test object and a Wratten 9™ filter, which permits significant transmission at wavelengths longer than 480 nm. Processing was conducted using the Eastman Flexicolor™ color negative processing chemicals and procedures.

Sensitometric speed comparisons are provided in Table III. Speed was measured at an optical density of 0.15 above minimum density. Emulsion 1C was assigned a relative speed of 100, and each unit of difference in reported relative speeds is equal to 0.01 log E, where represents exposure in lux-seconds.

TABLE III

| Speed Comparisons | |
|---|---|
| Emulsion | Relative Speed |
| 1C (comparative) | 100 |
| 2E (invention) | 111 |

To provide a frame of reference, in photography a relative speed increase of 30 (0.30 log E) allows one full stop reduction in exposure. Thus, it is apparent that the emulsion of the invention would allow a photographer a one half stop reduction in exposure.

Morphology Comparison

Grains from both Emulsions 1C and 2E were examined microscopically and observed to contain different tabular grain structures.

The iodide concentrations of a representative sample of the tabular grains were examined at different points across their major faces, either from edge-to-edge or corner-to-corner (see lines E—E and C—C, respectively, in the Brief Description of the Drawings above). Analytical electron microscopy (AEM) was employed. A major face of each tabular grain examined was addressed at a succession of points, and the average iodide concentration through the entire thickness of the tabular grain at each point addressed was read and plotted.

In FIG. 2 an edge-to-edge plot E2 and a corner-to-corner plot C2 are shown for a representative tabular grain taken from Emulsion 1C. Notice that in both plots the highest iodide concentration is found at the periphery of the tabular grain. There is no significant difference between the iodide concentration at a corner of the grain and at a peripheral location between the corners. All of the tabular grains examined from Emulsion 1C exhibited these edge and corner iodide profile characteristics.

A total of 60 tabular grains were examined from Emulsion 2E were examined. Of these 17 exhibited edge-to-edge and corner-to-corner iodide profiles similar to the tabular grains of Emulsion 1C. However, 43 of the tabular grains exhibited unique and surprising iodide profiles. An edge-to-edge iodide profile E1 and a corner-to-corner iodide profile C1 is shown in FIG. 1 for a tabular grain representative of the 43 tabular grains having unique structures. Notice that the highest iodide concentration is observed at the tabular grain peripheral edges of the edge-to-edge plot E1. On the other hand, the corner-to-corner plot C1 shows no significant variation in iodide content at the tabular grain periphery. Clearly the highest iodide concentrations in these unique tabular grains are located at the edges of the tabular grains, but the iodide content within the corners of the tabular grains are clearly significantly lower than that observed elsewhere along the tabular grain peripheral edges.

The invention has been described in detail with particular reference to preferred embodiments thereof, but it will be understood that variations and modifications can be effected within the spirit and scope of the invention.

What is claimed is:

1. An emulsion of enhanced photographic sensitivity comprised of a dispersing medium and silver halide tabular grains having a face centered cubic crystal lattice rock salt structure wherein:

the tabular grains contain a maximum surface iodide concentration along their edges and a lower surface iodide concentration within their corners than elsewhere along their edges.

2. An emulsion according to claim 1 wherein the tabular grains contain an overall iodide concentration of up to 20 mole percent, based on total silver.

3. An emulsion according to claim 2 wherein the tabular grains contain an overall iodide concentration of up to 15 mole percent, based on total silver.

4. An emulsion according to claim 1 wherein the tabular grains contain at least 50 mole percent bromide, based on total silver.

5. An emulsion according to claim 4 wherein the tabular grains are silver iodobromide, silver iodochlorobromide or silver chloroiodobromide grains.

6. An emulsion according to claim 1 wherein the surface iodide concentration of the tabular grains at a corner is at least 0.5 mole percent less than the maximum edge surface iodide concentration.

7. An emulsion according to claim 6 wherein the surface iodide concentration of the tabular grains at a corner is at least 1.0 mole percent less than the maximum edge surface iodide concentration.

* * * * *